US011054788B1

(12) United States Patent
Zhu et al.

(10) Patent No.: US 11,054,788 B1
(45) Date of Patent: Jul. 6, 2021

(54) CONDUCTIVE STRUCTURE AND PROCESS CARTRIDGE HAVING THE SAME

(71) Applicant: JIANGXI KILIDER TECHNOLOGY CO., LTD., Shangrao (CN)

(72) Inventors: Jinjun Zhu, Shangrao (CN); Zhongxi Li, Shangrao (CN); Jiabing He, Shangrao (CN)

(73) Assignee: JIANGXI KILIDER TECHNOLOGY CO., LTD., Shangrao (CN)

( * ) Notice: Subject to any disclaimer, the term of this patent is extended or adjusted under 35 U.S.C. 154(b) by 0 days.

(21) Appl. No.: 17/033,796

(22) Filed: Sep. 27, 2020

(30) Foreign Application Priority Data

Aug. 12, 2020 (CN) ..... 202010809272.1

(51) Int. Cl.
*G03G 15/02* (2006.01)
*G03G 21/18* (2006.01)
*G03G 21/16* (2006.01)

(52) U.S. Cl.
CPC ..... *G03G 21/1814* (2013.01); *G03G 15/0216* (2013.01); *G03G 21/1647* (2013.01); *G03G 21/1821* (2013.01)

(58) Field of Classification Search
CPC ..... G03G 15/0216; G03G 15/0233; G03G 15/80; G03G 21/1647; G03G 21/1652; G03G 21/1814; G03G 21/1821; G03G 2221/1693
See application file for complete search history.

(56) References Cited

U.S. PATENT DOCUMENTS

| | | | | |
|---|---|---|---|---|
| 5,768,660 | A * | 6/1998 | Kurihara | G03G 15/0216 361/221 |
| 6,064,841 | A * | 5/2000 | Matsuzaki | G03G 15/0216 361/225 |
| 2006/0115292 | A1* | 6/2006 | Sampe | G03G 15/0225 399/100 |
| 2016/0062309 | A1* | 3/2016 | Satomura | G03G 21/1814 399/111 |
| 2016/0216688 | A1* | 7/2016 | Katayama | G03G 21/1814 |
| 2016/0378014 | A1* | 12/2016 | Hoshino | G03G 15/0283 399/89 |
| 2017/0139340 | A1* | 5/2017 | Morishita | G03G 15/0216 |
| 2017/0176882 | A1* | 6/2017 | Gilliam | G03G 15/0233 |
| 2019/0018363 | A1* | 1/2019 | Yamaguchi | G03G 21/1821 |
| 2020/0096891 | A1* | 3/2020 | Yamamoto | G03G 15/0216 |

* cited by examiner

*Primary Examiner* — Sophia S Chen

(57) ABSTRACT

A conductive structure of a process cartridge that includes a cartridge body and a charging roller, includes: a first support member and a second support member arranged at opposite ends of the charging roller along an axial direction of the charging roller; a metal conductive member connected to the first support member, the conductive member including a first end penetrating the first support member and directly contacting the charging roller, and a second end located outside the first support member; a conductive spring connected to the second end of the conductive member, the conductive spring including a first end connected to the first support member, and a second end abutting against the cartridge body; and a conductive wire having one end connected to the conductive spring, wherein the conductive wire, the conductive spring, and the conductive member constitute a conductor for stable current delivery.

17 Claims, 10 Drawing Sheets

CONDUCTIVE STRUCTURE AND PROCESS CARTRIDGE HAVING THE SAME

CROSS REFERENCE TO RELATED APPLICATIONS

This application claims priority to Chinese Patent Application No. 202010809272.1, filed Aug. 12, 2020, which is hereby incorporated by reference herein as if set forth in its entirety.

BACKGROUND

1. Technical Field

The present disclosure generally relates to process cartridges of electrophotographic image forming devices, and particularly to a conductive structure of a process cartridge that improves enhances electrically conductive performance.

2. Description of Related Art

In an electrophotographic image forming device such as a laser printer, a laser photocopier, a facsimile apparatus, etc., a process cartridge is normally installed detachably, which is used for developing electro-static latent image. A process cartridge typically includes a drive assembly for receiving rotational force, a developing component, a developer, a doctor blade, and a housing for accommodating these components. In addition, depending on the type of the process cartridge, the process cartridge may further include a photosensitive component, a charging component, a cleaner, and an agitator. The drive assembly is arranged at one end of the process cartridge along an axial direction of a developing unit or a photosensitive unit. After the drive assembly comes into engagement with a drive head in the electrophotographic imaging device, rotating drive force is transmitted to the process cartridge. Rotating components, such as the developing component, the photosensitive component, and the agitator, inside the process cartridge are driven to rotate to participate in the image developing operation of the electrophotographic imaging device.

The charging component is used for providing sufficient charge onto the photosensitive component. After the process cartridge is installed in the electrophotographic imaging device, the charging component is electrically connected to the charging interface of the electrophotographic imaging device, and is ready to be charged. In some process cartridges, the charging component and the charging interface are connected by a conductive connecting member made of conductive plastic material. The electrically conductive performance of the conductive plastic material is not excellent, resulting in unstable conductive function and low printing quality, which restricts the improvement of the performance of the process cartridge.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
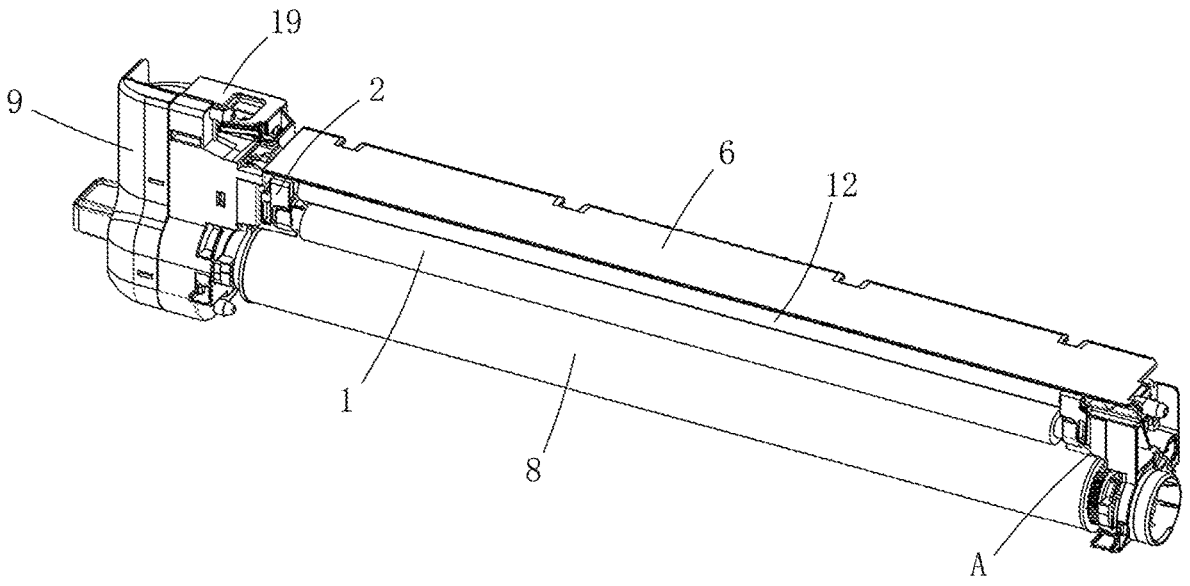
FIG. 1 is a schematic isometric view of a process cartridge according to one embodiment.
Figure 2:
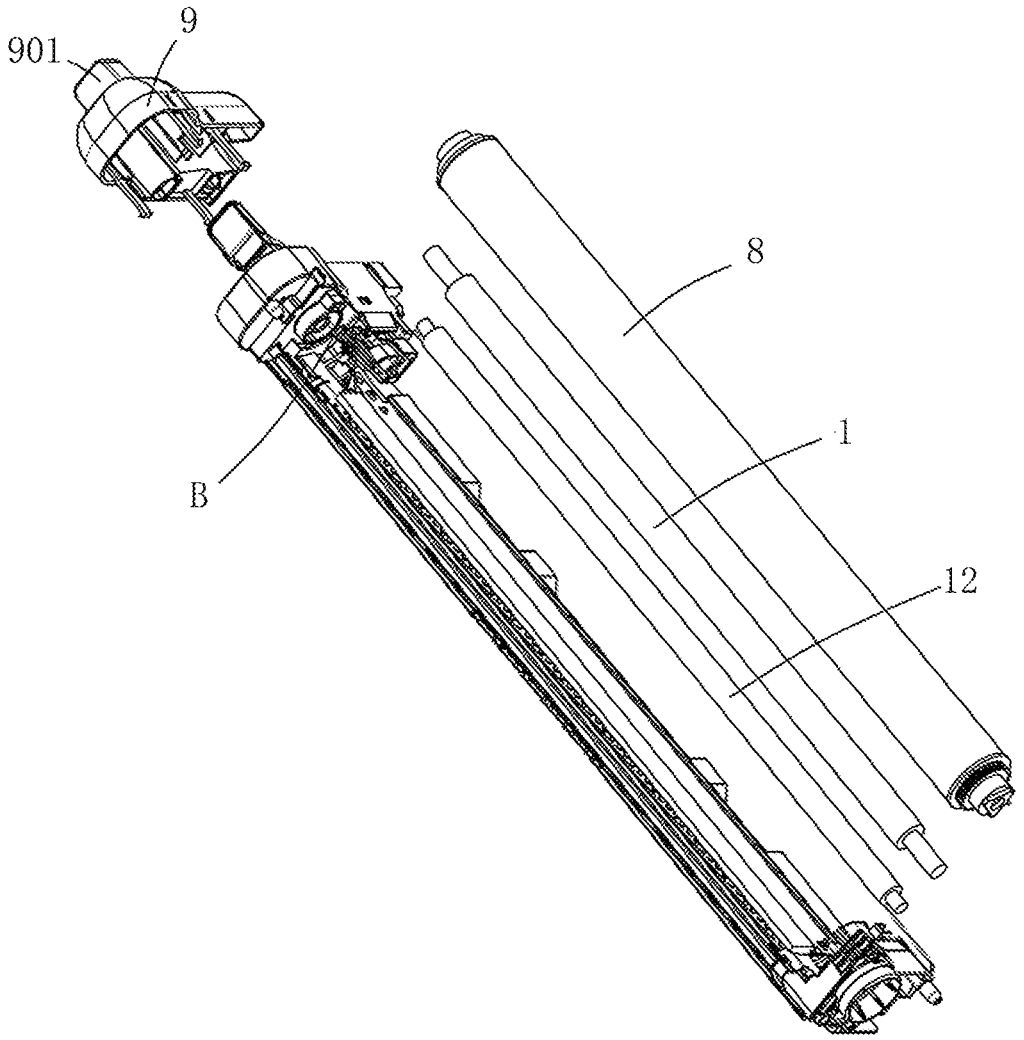
FIG. 2 is an isometric exploded view of the process cartridge of FIG. 1.
Figure 3:
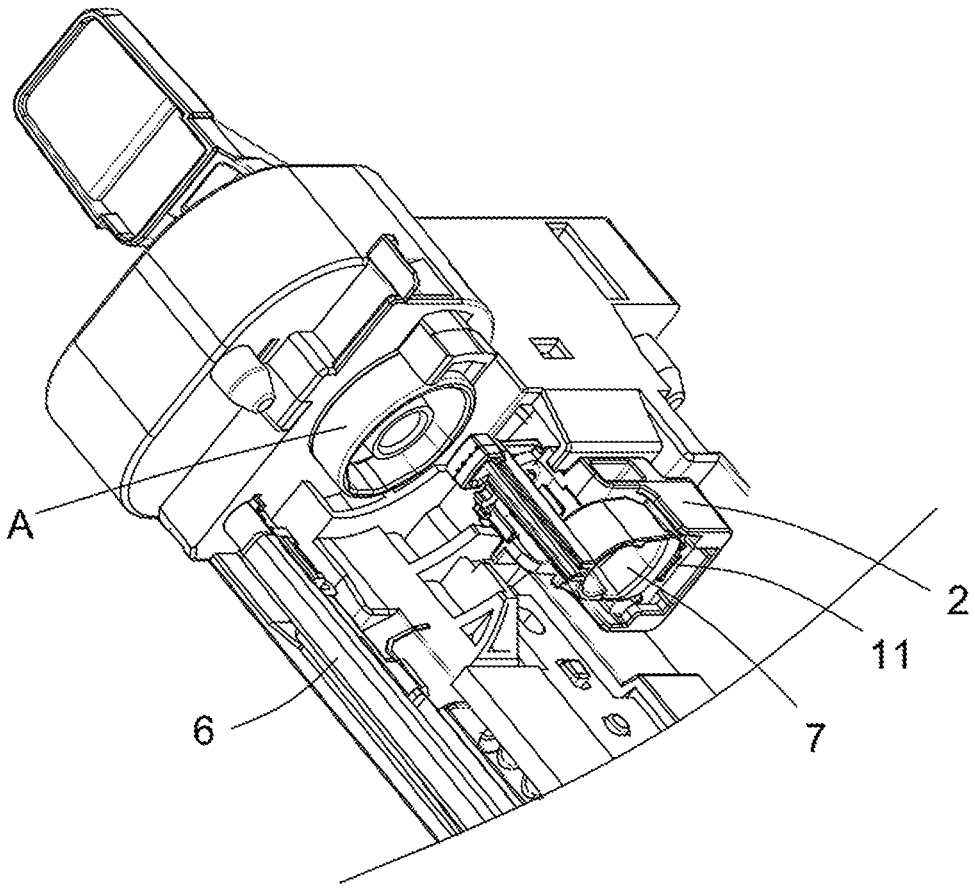
FIG. 3 is an enlarged view of a portion B of FIG. 2.
Figure 4:
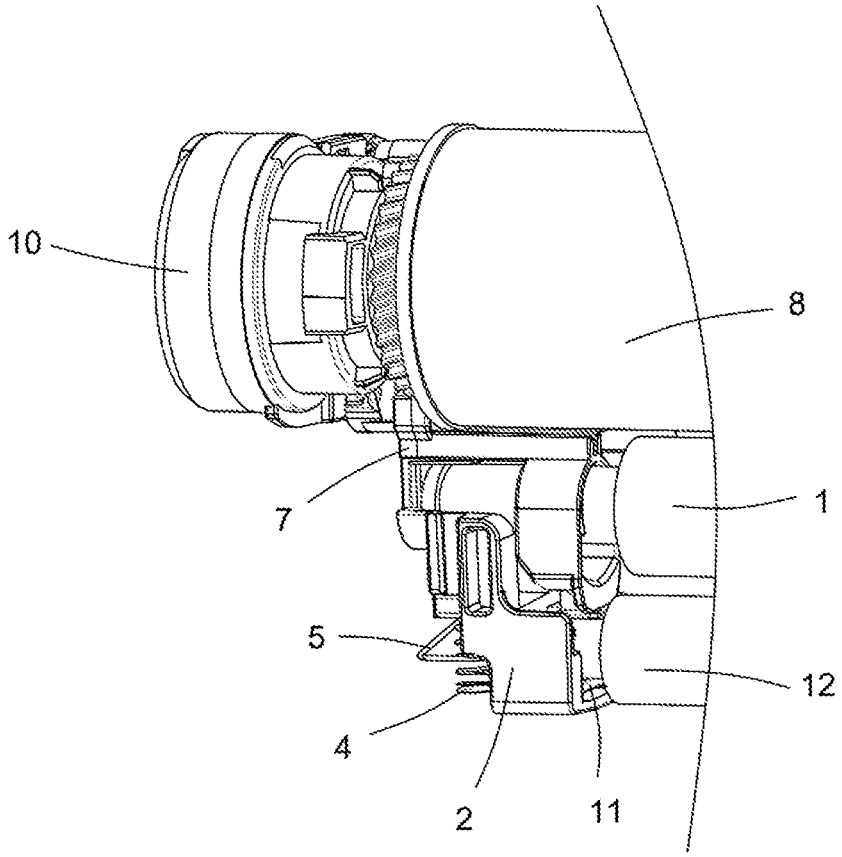
FIG. 4 is an enlarged view of portion of FIG. 1 that is opposite a portion A of FIG. 1.
Figure 5:
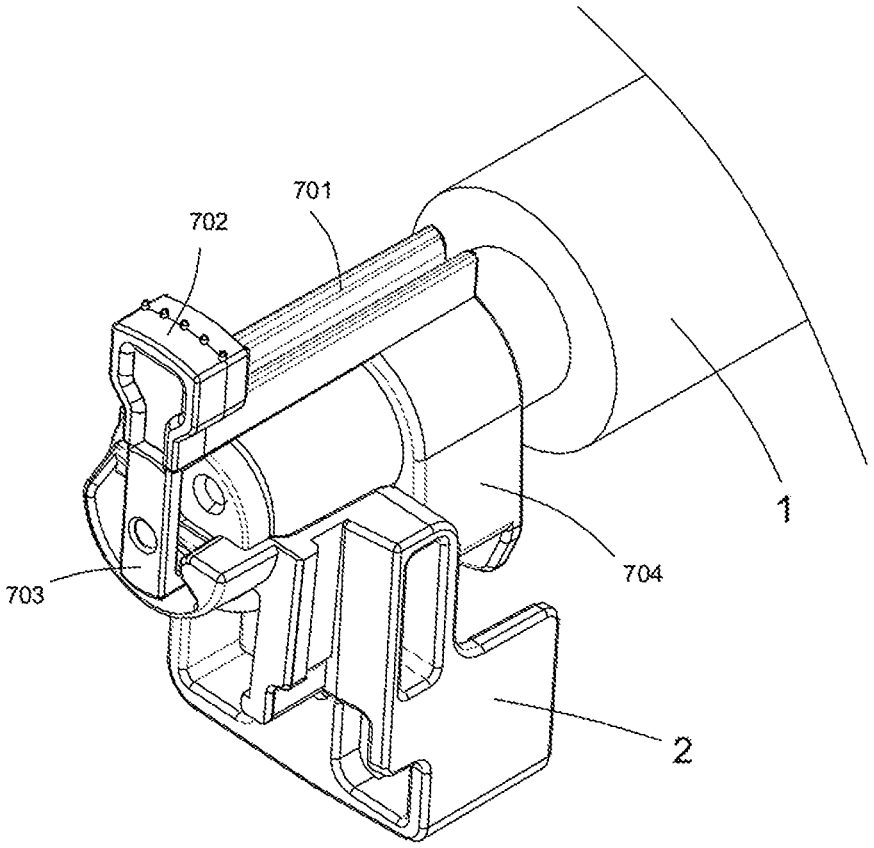
FIG. 5 shows the assembly of FIG. 4 in a different perspective, with certain components omitted for clarity.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

The terms "upper", "lower", "left" and "right", indicating the orientational or positional relationship based on the orientational or positional relationship shown in the drawings, are merely for convenience of description, but are not intended to indicate or imply that the device or elements must have a particular orientation or be constructed and operated in a particular orientation, and therefore should not be construed as limiting the present invention. The terms "first" and "second" are used for descriptive purposes only and are not to be construed as indicating or implying relative importance or implicitly indicating the number of technical features. The meaning of "multiple" is two or more, unless expressly stated otherwise.

Referring to FIGS. 4-7, in one embodiment, a conductive structure of process cartridge is configured to engage with a high-voltage conductive interface of an electrophotographic image forming device (e.g., a printer), which enables a charging roller 1 of the process cartridge to be stably connected to the electronic image forming device. The process cartridge includes a cartridge body 6 and the conductive structure is connected to the cartridge body 6. The conductive structure includes two support members (hereinafter a first support member 2 and a second support member 2), a conductive member 3, a conductive spring 4, and a conductive wire 5. The first support member 2 and the second support member 2 are arranged at opposite ends of the charging roller 1 along an axial direction of the charging roller 1. The first support member 2 is located adjacent to the high-voltage conductive interface of an electrophotographic image forming device when the process cartridge is put into the electrophotographic image forming device. The charging roller 1 is supported by the first support member 2 and the second support member 2. The conductive member 3 is made of metal and connected to the first support member 2. The conductive member 3 has a first end penetrating the first support member 2 and directly contacting the charging roller 1, and a second end located outside the first support member 2. The conductive spring 4 is connected to the second end of the conductive member 3. The conductive spring 4 has a first end connected to the first support member 2, and a second end abutting against the cartridge body 6. The conductive wire 5 has one end connected to the conductive spring 4. The conductive wire 5, the conductive spring 4, and the conductive member 3 constitute a conductor for stable current delivery. After the process cartridge is installed in the electrophotographic image forming device, the electrophotographic image forming device continuously outputs current to the charging roller 1 through the conductive wire 5, the conductive spring 4, and the conductive member 3.

In one embodiment, the conductive member 3 and the first support member 2 are integrally formed by molding. The conductive member 3 is a metal conductor. During the manufacturing process, the conductive member 3 is put into a mold, and then molten material (e.g., molten plastic) is poured into the mold. The conductive member 3 and the first support member 2 are thus molded into a single-piece component. In this way, the conductive member 3 is tightly connected with the first support member 2 to ensure structural stability, thereby ensuring electrically conductive performance, avoiding poor high-voltage contact, and improving printing quality.

Figure 6:
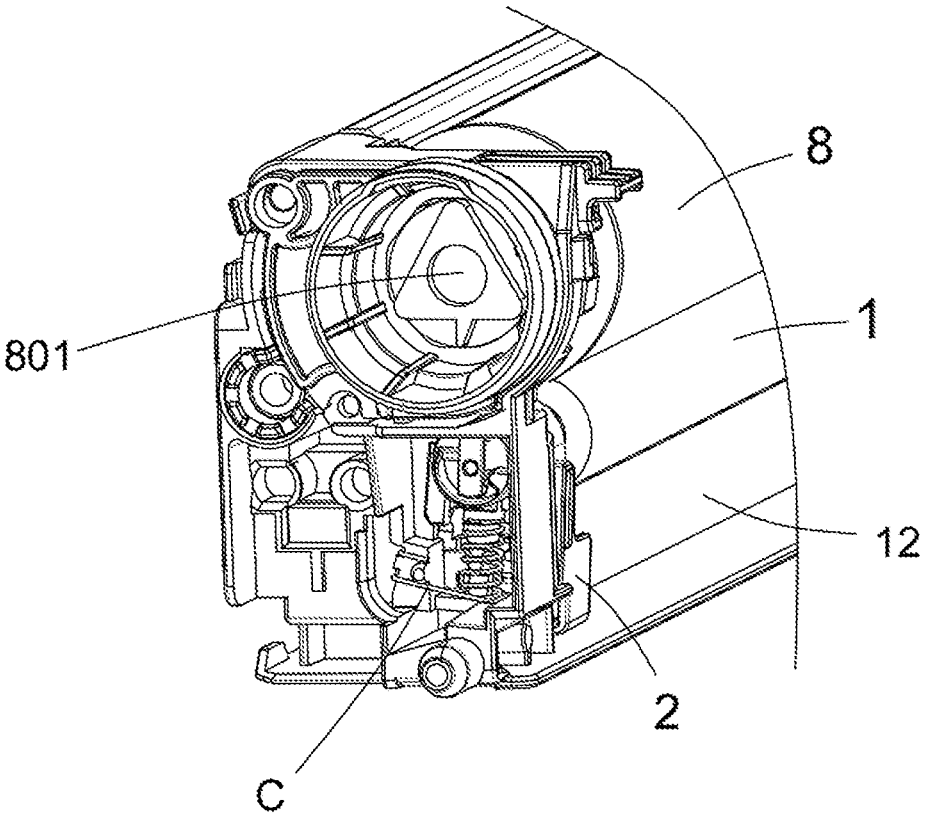
FIG. 6 shows the assembly of FIG. 4 in a different perspective, with certain components omitted for clarity.
Figure 7:
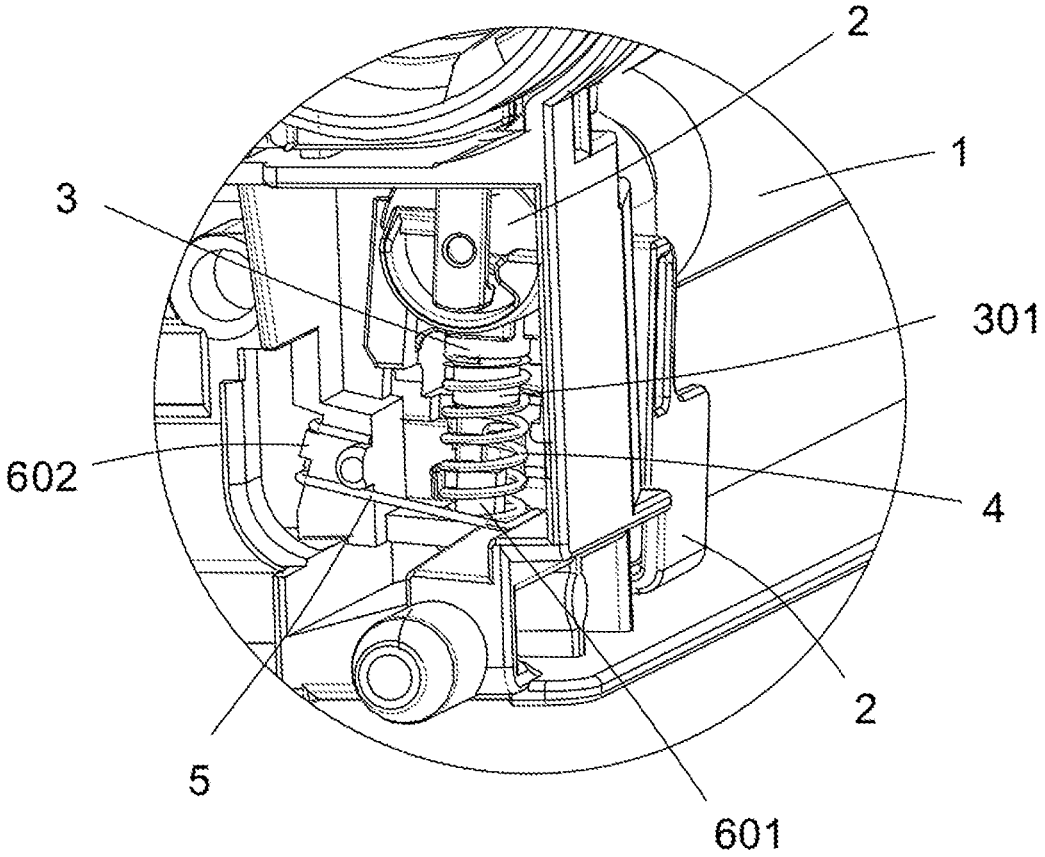
FIG. 7 is an enlarged view of a portion C of FIG. 6.
Figure 8:
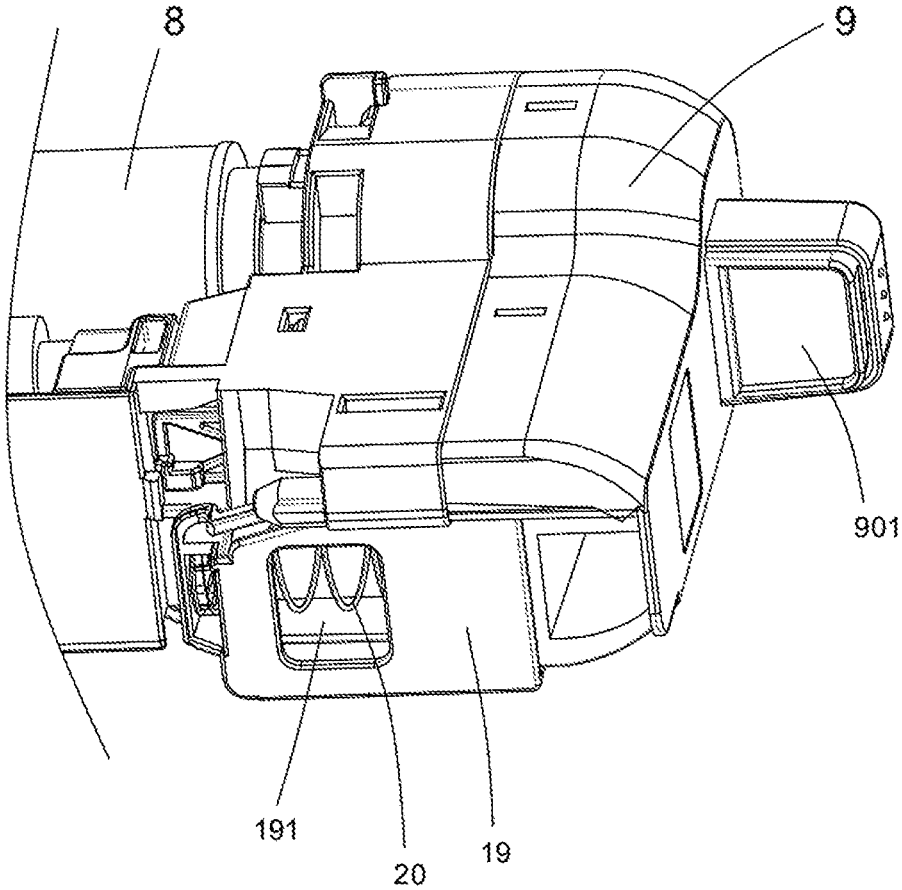
FIG. 8 shows the assembly of FIG. 3 in a different perspective.
Figure 9:
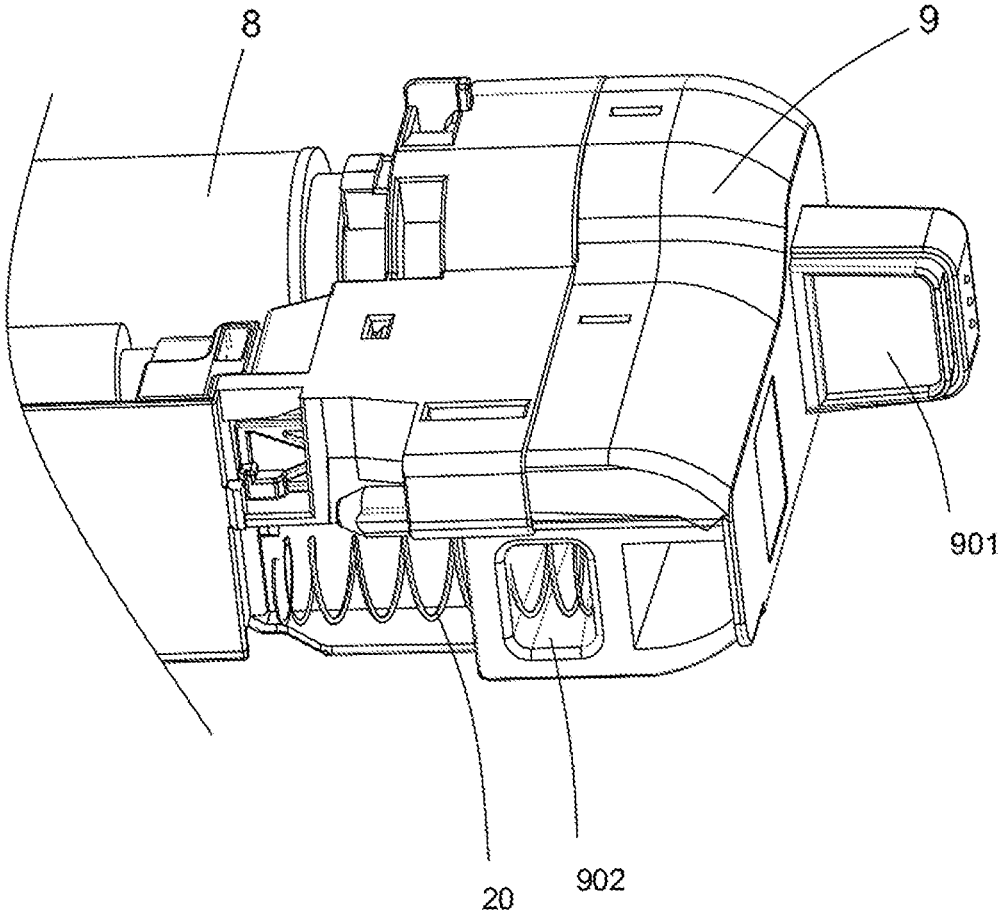
FIG. 9 is similar to FIG. 8, with one component omitted for clarity.
Figure 10:
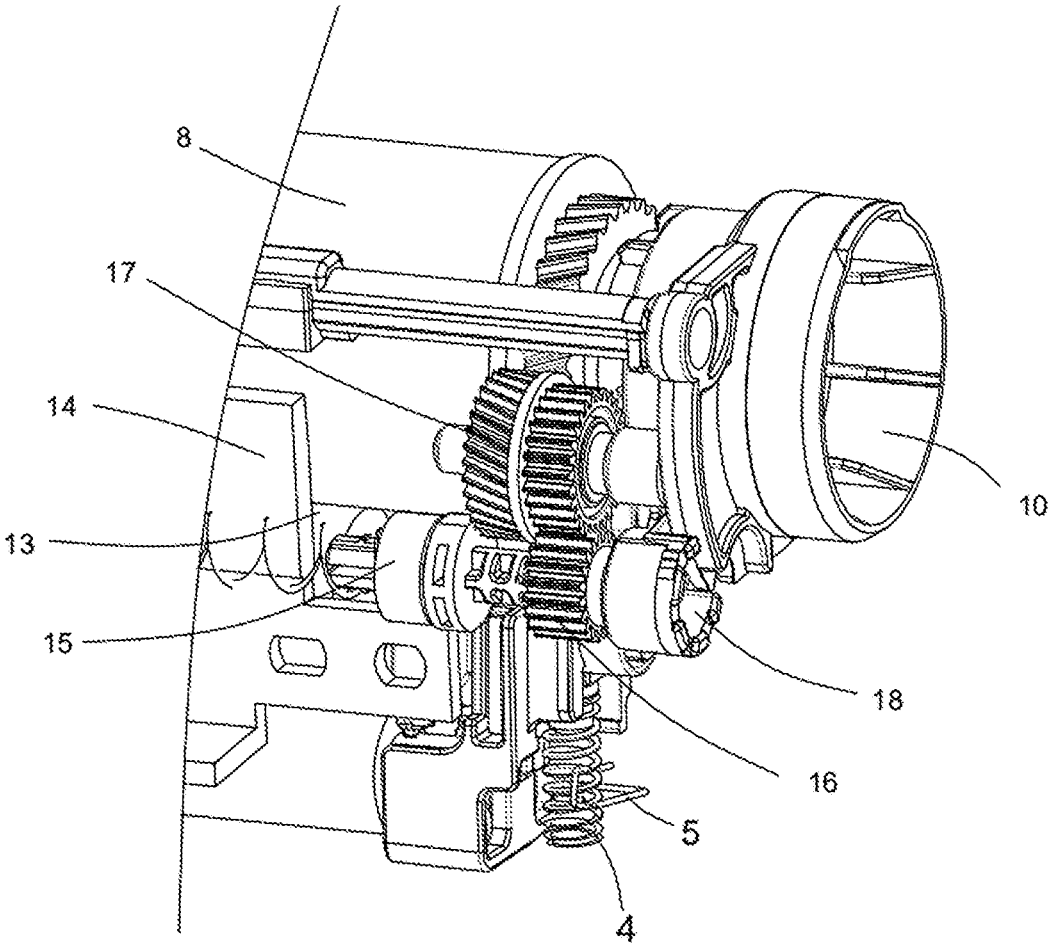
FIG. 10 shows the assembly of FIG. 4 in a different perspective, with certain components omitted for clarity.

In one embodiment, the conductive member 3 includes a cylindrical portion 301 located outside the first support member 2. The conductive spring 4 is arranged around the conductive member 3, and the first end (i.e., the top end as shown in FIG. 6) of the conductive spring 4 abuts against an end of the cylindrical portion 301. In addition to the conductive connection function, the conductive spring 4 also has the function of pushing the first support member 2 upward, so that the charging roller 1 can always contact a drum core 8 during operation, and sufficient charge can be provided onto the drum core 8. The conductive spring 4 is arranged around the conductive member 3, which limits lateral displacement of the conductive spring 4.

The cartridge body 6 includes a post 601 extending along an axial direction of the conductive member 3. The conductive spring 4 is arranged around the post 601 and abuts against the cartridge body 6. The post 601 and the conductive member 3 restrict lateral displacement of the opposite ends of the conductive spring 4 respectively.

The conductive wire 5 is fixed to the cartridge body 6. The cartridge body 6 is provided with a positioning protrusion 602 at a position facing the high-voltage conductive interface of the electrophotographic image forming device after the process cartridge is put into the electrophotographic image forming device. The conductive wire 5 includes a plurality of bent portions that are connected to one another. A first of the bent portions is arranged around the positioning protrusion 602, and a second of the bent portions is arranged around the post 601 and is pressed against the cartridge body 6 by the conductive spring 4. The conductive wire 5 is always in electrical connection with the conductive spring 4.

The conductive wire 5 and the conductive spring 4 can be separately or integrally formed. When they are integrally formed, the electrical connection between the conductive wire 5 and the conductive spring 4 is in an absolutely stable state, but it is difficult to manufacture and install them. In the embodiment, the conductive wire 5 and the conductive spring 4 are separately formed. The second of the bent portions of the conductive wire passes through the last coil of the conductive spring 4 and is tightly pressed against the cartridge body 6 by the conductive spring 4, which enables the conductive wire 5 to be always in electrical connection with the conductive spring 4.

In one embodiment, the conductive structure further includes a separation member 7. During the storage and transportation of the process cartridge before use, the separation member 7 separates the charging roller 1 from the drum core 8 such that no charge will be provided onto the drum core 8. The separation member 7 includes a main body 701 protruding from the one end of the charging roller 1. An engaging portion 702 protrudes upward from the lateral surface of the main body 701 adjacent to a first end of the main body 701. A support portion 703 extends downward from the engaging portion 702. A pushing portion 704 protrudes downward from the lateral surface of the main body 701 adjacent to a second end of the main body 701. The support portion 703 is connected to the first support member 2. The engaging portion 702 is engaged with the drum core 8 that is located above the engaging portion 702, which further compresses the conductive spring 4 and drives the first support member 2 to move downward to be disengaged from the drum core 8. One end of the charging roller 1 passes through the pushing portion 704 and is supported by the first support member 2. The pushing portion 704 extends along an axial direction of the charging roller 1 and contacts the first support member 2. The separation member 7 and the first support member 2 constitute a single integrated component in the axial direction of the charging roller 1. When the process cartridge is put into the electrophotographic image forming device and before the electrophotographic image forming device is started, the separation member 7 and the first support member 2 need to be pushed by an axial pushing force, the separation member 7 and the first support member 2 move synchronously along the axial direction of the charging roller 1. The engaging portion 702 can then be disengaged from the drum core 8, which allows the conductive spring 4 to push the separation member 7 and the first support member 2 to move upward so as to move the charging roller 1 to come into contact with the drum core 8.

With such configuration, the process cartridge of the present disclosure can enhance electrically conductive performance, avoid poor high-voltage contact, and improve printing quality. During the manufacturing process, the conductive member 3 is put into a mold, and then molten material (e.g., molten plastic) is poured into the mold. The conductive member 3 and the first support member 2 are thus molded into a single-piece component. In this way, the conductive member 3 is tightly connected with the first support member 2 to ensure structural stability, thereby ensuring electrically conductive performance.

Referring to FIGS. 1-3 and 8-10, in one embodiment, a process cartridge includes the conductive structure as described above.

In one embodiment, the process cartridge further includes a side cap 9 connected to one end of the cartridge body 6. The side cap 9 includes a protruding handle 901. When the process cartridge is put in the electrophotographic image forming device, the handle 901 is engaged with a groove in the electrophotographic image forming device to guide the process cartridge to a desired position. The cartridge body 6 defines a receiving space, and two sleeves 10, and the first support member 2, and the second support member 2 are received in the receiving space. The drum core 8 is supported by the two sleeves 10. A space is formed between a gear located adjacent to one end of the drum core 8 and one of the two sleeves 10, and a portion of the separation member 7, such as the engaging portion 702, moves into the space after disengagement from the drum core 8. The drum core 8 includes a connecting portion 801 at one end, and the connecting portion 801 is configured to mate with a coupling portion of the electrophotographic image forming device. Through the engagement of the connecting portion 801 with the coupling portion, the electrophotographic image forming device can drive the drum core 8 to rotate. The first support member 2 is also provided with a cleaning roller side cap 11, and the process cartridge further includes a cleaning roller 12 arranged under the charging roller 1. The cleaning roller 12 is arranged on the cleaning roller side cap 11.

In one embodiment, the process cartridge further includes a toner collecting assembly. The toner collecting assembly includes a waste toner tank 13, and a flexible scraper 14 and a rotating shaft 15 that are located in the waste toner tank 13. The rotating shaft 15 includes a spiral tab arranged around its lateral surface. The rotating shaft 15 includes a shaft gear 16 at one end away from the side cap 9. The shaft gear 16 is engaged with the gear of the drum core 8 through a transmission gear 17. The rotating shaft 15 includes a connecting block 18 at an end adjacent to the shaft gear 16. The connecting block 18 includes a number of projections that contact an inner surface of one corresponding sleeve 10, and the transmission gear 17 is connected with the sleeve 10. The drum core 8 is driven by the electrophotographic image forming device to rotate, and the rotating shaft 15 is driven to rotate through the by the engagement between the drum core 8 and the transmission gear 17, as well as the transmission gear 17 and the shaft gear 16.

In one embodiment, the process cartridge further includes a toner cap 19 located adjacent to the side cap 9. The side cap 9 defines a channel 902 in communication with the waste toner tank 13. The toner cap 19 is slidable with respect to the side cap 9, and is configured to control discharge of toner. One end of the toner cap 19 is slidably connected to the side cap 9, and an opposite end extends into the cartridge body 6. A spring 20 is arranged between the opposite end of the toner cap 19 and the cartridge body 6. The toner cap 19 defines a through hole 191.

The toner cap 19 blocks a toner discharge channel of the process cartridge under the action of the spring 20. When the process cartridge is put into the electrophotographic image forming device, a user can hold the handle 901, and then gradually push the process cartridge into the electrophotographic image forming device. During the pushing process, the toner cap 19 interacts with the electrophotographic image forming device and the toner cap 19 slides, and the through hole 191 of the toner cap 19 is aligned with the channel 902 of the process cartridge. During the operation of the electrophotographic image forming device, about 10% of the developer cannot be completely absorbed onto the paper and remains on the drum core 8. The remaining developer will be scraped off by the scraper 14 and fall into the waste toner tank 13. At the same time, the electrophotographic image forming device drives the drum core 8 to rotate through the connecting portion 801, and then drives the rotating shaft 15 to rotate. The spiral tab on the rotating shaft 15 transfers the waste developer along the axial direction of the rotating shaft 15 and discharges the waste developer out from the channel 902.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A conductive structure of a process cartridge that comprises a cartridge body and a charging roller, the conductive structure comprising:

a first support member and a second support member arranged at opposite ends of the charging roller along an axial direction of the charging roller, the charging roller supported by the first support member and the second support member;

a metal conductive member connected to the first support member, the conductive member comprising a first end penetrating the first support member and directly contacting the charging roller, and a second end located outside the first support member;

a conductive spring connected to the second end of the conductive member, the conductive spring comprising a first end connected to the first support member, and a second end abutting against the cartridge body; and a conductive wire having one end connected to the conductive spring, wherein the conductive wire, the conductive spring, and the conductive member constitute a conductor for stable current delivery.

2. The conductive structure of claim 1, wherein the conductive member and the first support member are integrally formed by molding.

3. The conductive structure of claim 1, wherein the conductive member comprising a cylindrical portion located outside the first support member, the conductive spring is arranged around the conductive member, and the first end of the conductive spring abuts against an end of the cylindrical portion.

4. The conductive structure of claim 3, wherein the cartridge body comprises a post extending along an axial direction of the conductive member, the conductive spring is arranged around the post.

5. The conductive structure of claim 4, wherein the conductive wire comprises a plurality of bent portions, the cartridge body comprises a positioning protrusion, a first of the bent portions is arranged around the positioning protrusion, a second of the bent portions is arranged around the post and is pressed against the cartridge body by the conductive spring.

6. The conductive structure of claim 5, wherein the conductive wire and the conductive spring are separately formed, the second of the bent portions passes through a last coil of the conductive spring.

7. The conductive structure of claim 1, further comprising a separation member, wherein the separation member comprises a main body, an engaging portion protrudes upward from a first end of the main body, a support portion extends downward from the engaging portion, a pushing portion protrudes downward from a second end of the main body, the support portion is connected to the first support member, the engaging portion is engaged with a drum core, which drives the first support member to move downward to be disengaged from the drum core, one end of the charging roller passes through the pushing portion and is supported by the first support member, the pushing portion extends along an axial direction of the charging roller and contacts the first support member, when the separation member and the first support member are pushed by an axial pushing force, the separation member and the first support member move synchronously, the engaging portion is disengaged from the drum core, which allows the conductive spring to push the separation member and the first support member to move upward so as to move the charging roller to come into contact with the drum core.

8. A process cartridge comprising:

a cartridge body;

a charging roller; and a conductive structure comprising:

a first support member and a second support member arranged at opposite ends of the charging roller along an axial direction of the charging roller, the charging roller supported by the first support member and the second support member;

a metal conductive member connected to the first support member, the conductive member comprising a first end penetrating the support member and directly contacting the charging roller, and a second end located outside the support member;

a conductive spring connected to the second end of the conductive member, the conductive spring comprising a first end connected to the first support member, and a second end abutting against the cartridge body; and a conductive wire having one end connected to the conductive spring, wherein the conductive wire, the conductive spring, and the conductive member constitute a conductor for stable current delivery.

9. The process cartridge of claim 8, wherein the conductive member and the first support member are integrally formed by molding.

10. The process cartridge of claim 8, wherein the conductive member comprising a cylindrical portion located outside the first support member, the conductive spring is arranged around the conductive member, and the first end of the conductive spring abuts against an end of the cylindrical portion.

11. The process cartridge of claim 10, wherein the cartridge body comprises a post extending along an axial direction of the conductive member, the conductive spring is arranged around the post.

12. The process cartridge of claim 11, wherein the conductive wire comprises a plurality of bent portions, the cartridge body comprises a positioning protrusion, a first of the bent portions is arranged around the positioning protrusion, a second of the bent portions is arranged around the post and is pressed against the cartridge body by the conductive spring.

13. The process cartridge of claim 12, wherein the conductive wire and the conductive spring are separately formed, the second of the bent portions passes through a last coil of the conductive spring.

14. The process cartridge of claim 8, further comprising a separation member, wherein the separation member comprises a main body, an engaging portion protrudes upward from a first end of the main body, a support portion extends downward from the engaging portion, a pushing portion protrudes downward from a second end of the main body, the support portion is connected to the first support member, the engaging portion is engaged with a drum core, which drives the first support member to move downward and is disengaged from the drum core, one end of the charging roller passes through the pushing portion and is supported by the first support member, the pushing portion extends along an axial direction of the charging roller and contact the first support member, when the separation member and the first support member are pushed by an axial pushing force, the separation member and the first support member move synchronously, the engaging portion is disengaged from the drum core, which allows the conductive spring to push the separation member and the first support member to move upward so as to move the charging roller to come into contact with the drum core.

15. The process cartridge of claim 8, further comprising a side cap connected to one end of the cartridge body, the side cap comprises a protruding handle, the cartridge body defines a receiving space, two sleeves, the first support member, and the second support member are received in the receiving space, the drum core is supported by the two sleeves, a space is formed between an end of the drum core and one of the two sleeves, and the separation member moves into the space after disengagement from the drum core.

16. The process cartridge of claim 15, further comprising a toner collecting assembly, wherein the toner collecting assembly comprises a waste toner tank, a flexible blade, and a rotating shaft that are located in the waste toner tank, the rotating shaft comprises a shaft gear at one end away from the side cap, the shaft gear is engaged with a gear of the drum core through a transmission gear, the rotating shaft comprises a connecting block at an end adjacent to the shaft gear, the connecting block comprises a plurality of projections that contact an inner surface of the sleeve, and the transmission gear is connected with the sleeve.

17. The process cartridge of claim 16, further comprising a toner cap located adjacent to the side cap, wherein the side cap defines a channel in communication with the waste toner tank, the toner cap is slidable with respect to the side cap, and is configured to control discharge of toner.

* * * * *